United States Patent [19]

Parker et al.

[11] Patent Number: 4,530,395

[45] Date of Patent: Jul. 23, 1985

[54] SINGLE ZONE HVAC CONTROLLED FOR OPERATION IN MULTIPLE ZONE ARRANGEMENT

[75] Inventors: Jeffrey L. Parker; Edward Parker, both of Jacksonville, Fla.

[73] Assignee: Parker Electronics, Inc., Jacksonville, Fla.

[21] Appl. No.: 454,483

[22] Filed: Dec. 29, 1982

Related U.S. Application Data

[63] Continuation-in-part of Ser. No. 434,259, Oct. 14, 1982.

[51] Int. Cl.[3] ..... F25B 29/00; F24F 7/00

[52] U.S. Cl. ..... 165/16; 165/22; 236/49; 236/1 C

[58] Field of Search ..... 236/49, 1 B, 1 C, 151; 165/16, 22, 26; 364/557, 505

[56] References Cited

U.S. PATENT DOCUMENTS

| | | | |
|---|---|---|---|
| 3,901,310 | 8/1975 | Strawn | 165/22 |
| 4,276,925 | 7/1981 | Palmieri | 364/505 X |
| 4,294,404 | 10/1981 | Gajjar | 236/49 X |
| 4,352,349 | 10/1982 | Yoho | 236/49 |

*Primary Examiner*—William E. Wayner
*Attorney, Agent, or Firm*—Arthur G. Yeager

[57] ABSTRACT

A monitoring and control system for a heating, ventilating and air conditioning (HVAC) unit which provides zone control in plural zones in which each zone includes a control thermostat that is interfaced with the monitoring system so that each zone thermostat controls the HVAC unit as well as a damper unit for that particular zone thereby enabling independent zonal control in a multiple zone system which uses a single zone HVAC unit. The monitor considers individual zone needs, damper positions, amount of demand in the zone, mode of the zone damper and other factors which affect the comfort of zone occupants and, in response to signals from the thermostats, decides how and when to control the HVAC unit so that, in effect, a single zone HVAC unit becomes a multiple zone system. The system is comprised of two or more computerized thermostats which control both the HVAC unit through the monitoring control and the air distribution system of each zone through the damper for each zone, creating a heating, cooling, variable air volume and variable temperature control system. The thermostats also operate under control of signals received from the monitor.

45 Claims, 14 Drawing Figures

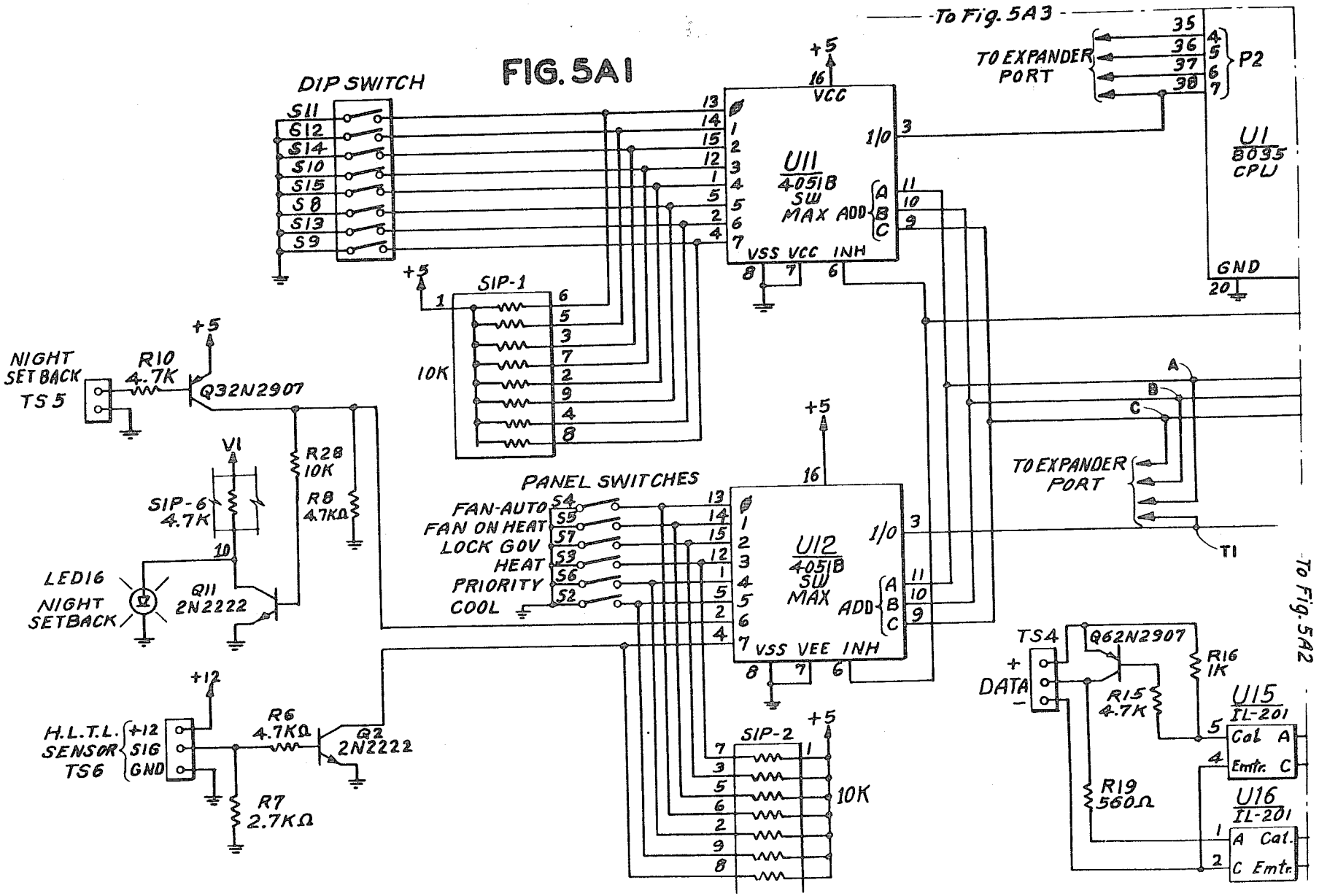
FIG. 5A1

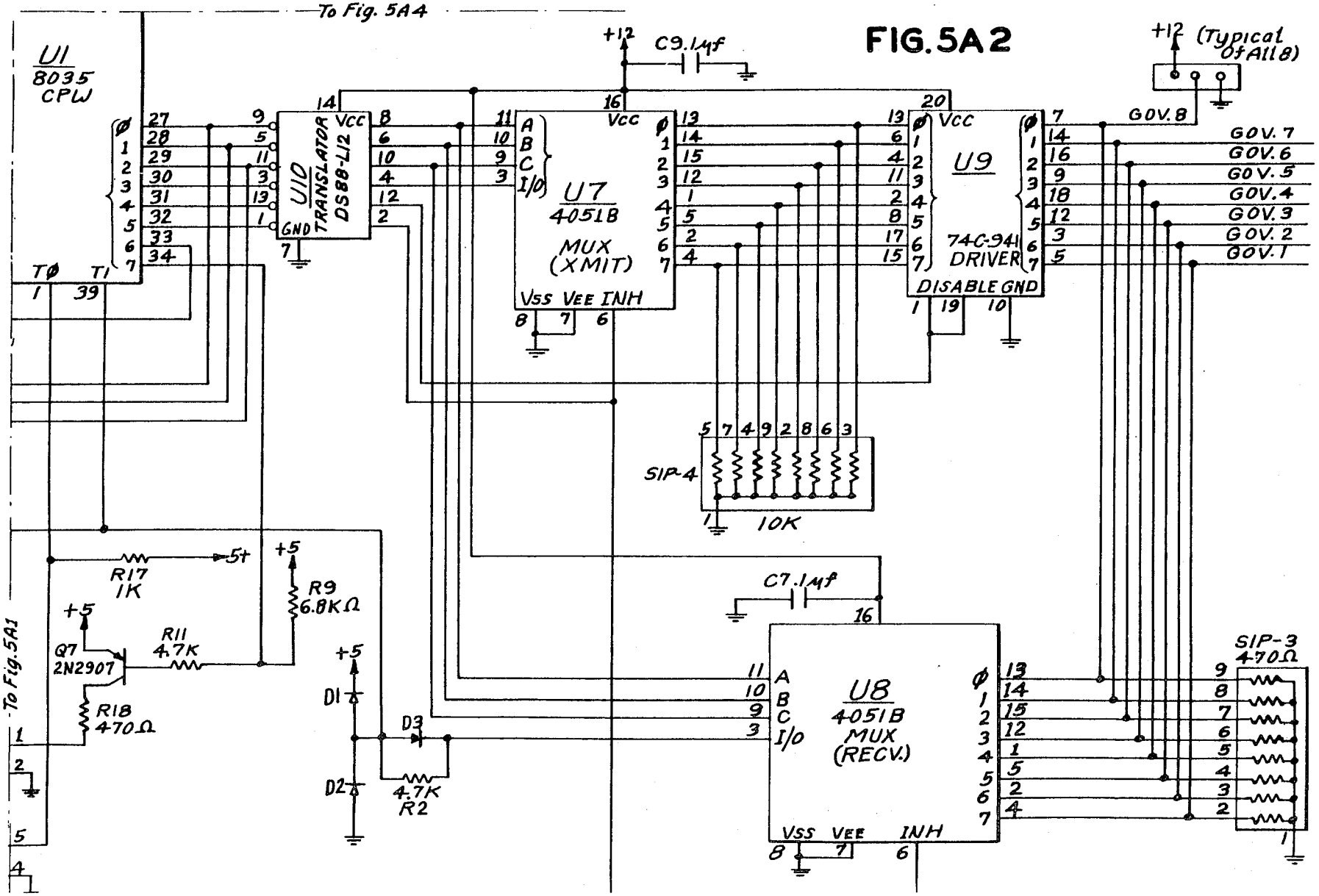
FIG. 5A2
To Fig. 5A4
To Fig. 5A1
U1
8035
CPU
U10
TRANSLATOR
DS88-L12
U7
4051B
MUX
(XMIT)
U9
74C-941
DRIVER
DISABLE GND
U8
4051B
MUX
(RECV.)
SIP-4
10K
SIP-3
470Ω
C9.1μf
C7.1μf
+12
(Typical of All 8)
GOV.8
GOV.7
GOV.6
GOV.5
GOV.4
GOV.3
GOV.2
GOV.1
R9
6.8KΩ
R17
1K
R11
4.7K
R18
470Ω
Q7
2N2907
D1
D2
D3
R2
4.7K
+5

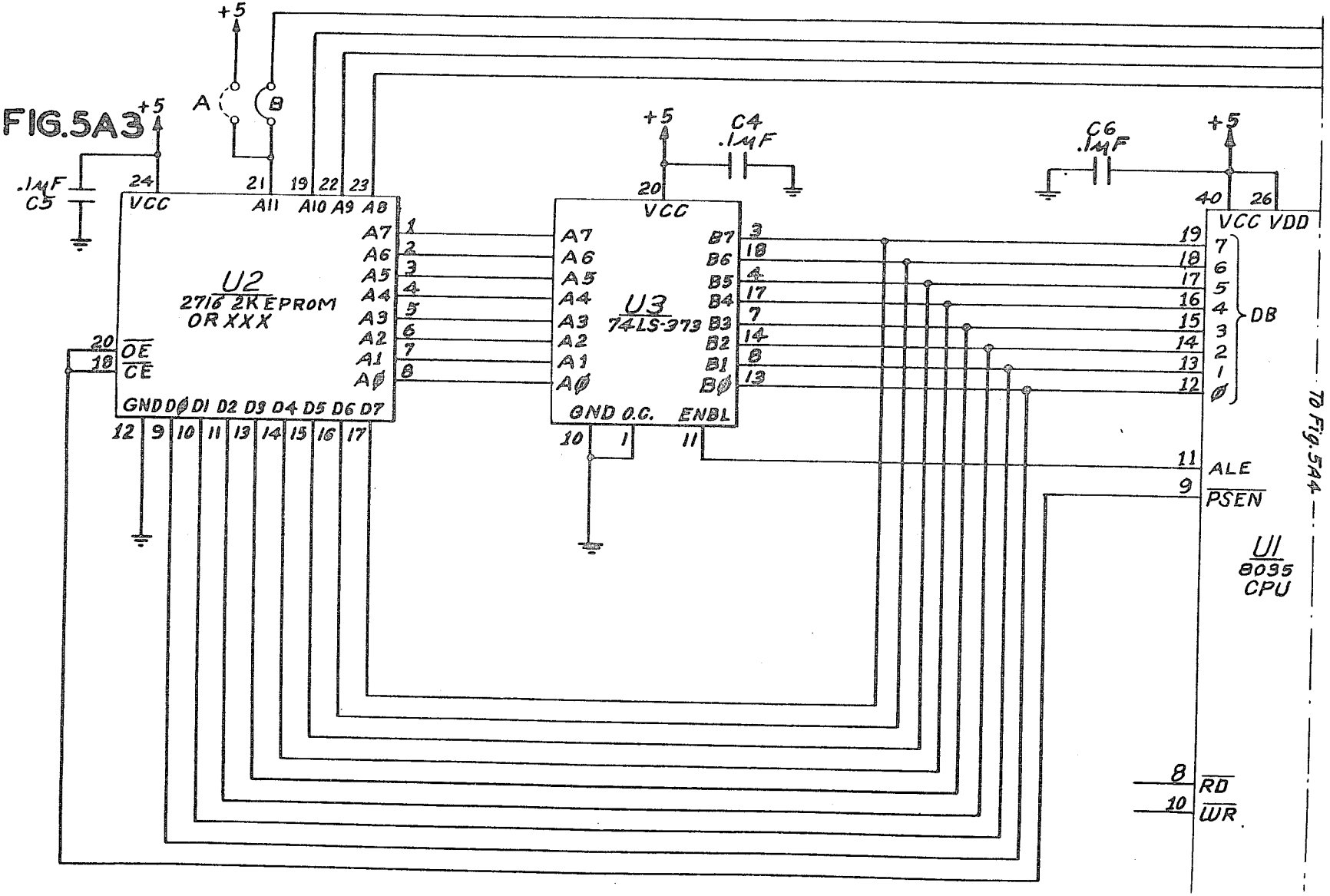
FIG. 5A3

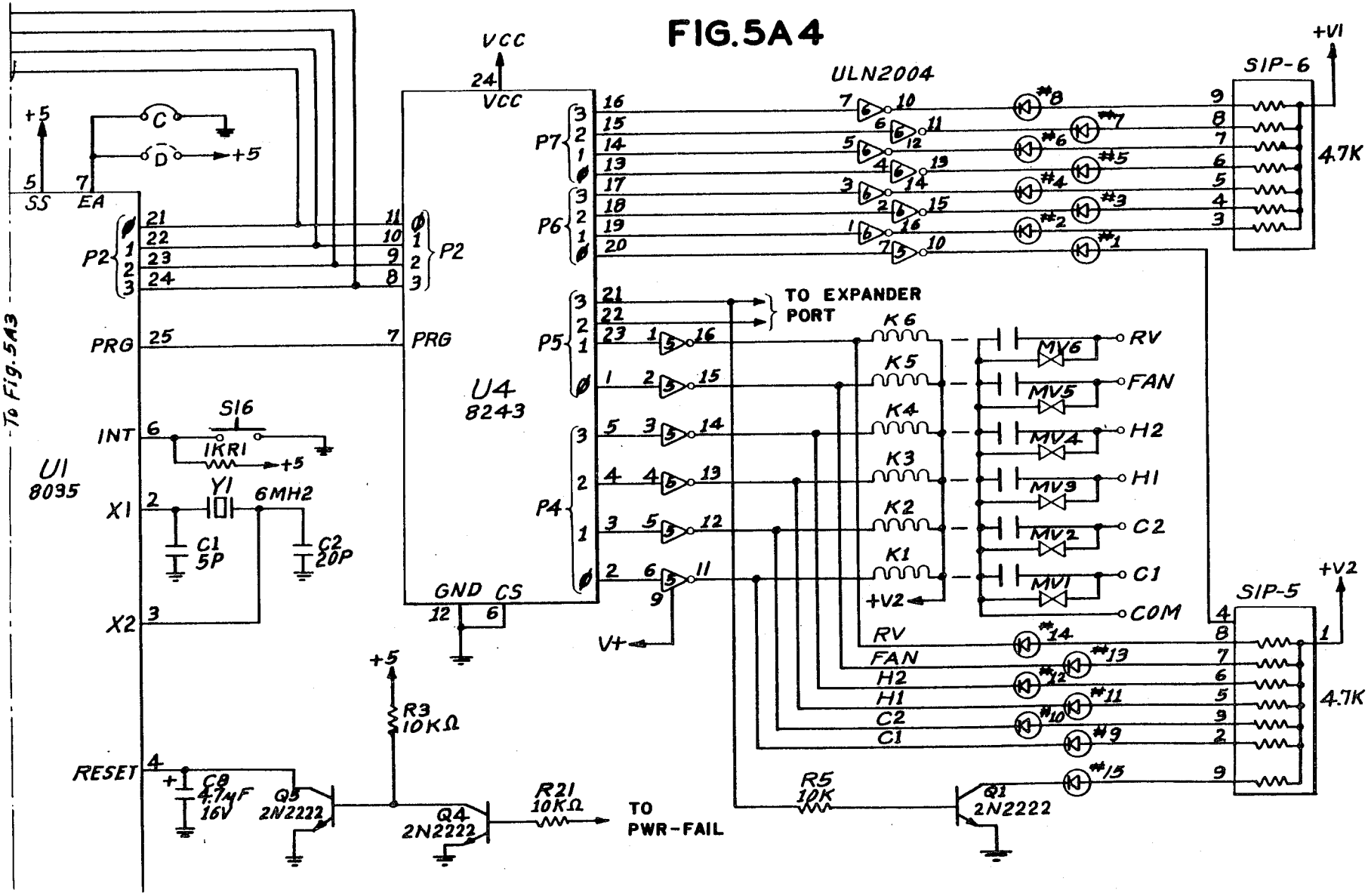
FIG. 5A4

FIG. 5b1
OPTIONAL EXPANDER PORT
V+
U1-39
T1
U1-38
U1-37
U1-36
U1-35
P2
GND
GND
FIG. 5b2
V+
U4-21
U4-22
P5
ADDRESS SELECT
GND
GND
FIG. 5b3
+V1
SIP-6
LED #17 PWR ON

+12
Q10 2N2907
SWITCHED 12V
+5
Q8 2N2907
SWITCHED VCC
R12 10K
R4 4.7KΩ
D9 1N4148
Q9 2N2222
R20 10KΩ
PWR-FAIL
D8 1N4148
U14
LM358
20.5KΩ 1% R23
9.53KΩ R13 1%
9.31KΩ R14 1%
1.21KΩ R22 1%
6.65KΩ R24 1%
VCC P16/U11
C10 .1μF
C11 .1μF
VR1 34OT -5
+12V
C3 .1μF
VR2 34OT -12
C14 .1μF
+V2
R25 50Ω 5W
R26 50Ω 5W
R27 25Ω 5W
C12 470μF 50V.
+V1
C13 1000μF 50V.
S1 POWER
1N4005 D4
D5
D7
1N4005
D6
TS3 24VAC POWER
C15 .1μF
CHASSIS GROUND

+5V
Q2 2N2907
OUT
R9 10K
R8 10K
C4 .1uf DISC
D2 1N4148
C5 .1uf DISC
RESET
Vcc
TRIG
DISCH
CN
THRESH
U2
LM 555
GND
Q
R7 10K
CLIP OR INSERT JUMPER
AS NEEDED TO CALIBRATE
U1 LM311N
OUT E
Q1 2N2222
R10 10K
CCW
J1
R4 10K
CAL POT
R5 6.65K 1%
R6 127K
1%
C2
.1uf
DISC
C3 .1uf
POLYCORBONATE
R3 4.99K 1%
R2
887K
1%
THERMISTOR
CONNECTION

VR1
LM340T5
C1
10uf 16V
RADIAL
D1 1N4001
R1 100Ω
OUT
C6 .1uf
TS1

SINGLE ZONE HVAC CONTROLLED FOR OPERATION IN MULTIPLE ZONE ARRANGEMENT

CROSS REFERENCE TO RELATED APPLICATIONS

This application is a continuation-in-part of our prior application, Ser. No. 434,259, filed Oct. 14, 1982 which is incorporated herein by reference.

FIELD OF THE INVENTION

The present invention generally relates to the monitoring and control of a single zone HVAC unit which enables it to independently control conditions in a plurality of zones with each zone including a thermostat and damper interfaced with the monitor control in a manner to enable the single zone HVAC unit to be utilized in a multiple zone arrangement.

DESCRIPTION OF THE PRIOR ART

Various control systems have been provided for maintaining occupant comfort in a single zone or plurality of zones. Our prior copending applications, Ser. No. 362,142, filed Mar. 26, 1982 and Ser. No. 434,259, filed Oct. 14, 1982, each for Temeprature Control System disclose a temperature control system employing a damper and thermostat arrangement associated with a single zone for controlling the conditions in that zone, these also being exemplary of the air prior to this application. The prior art cited in the aforementioned copending applications is also included in this application as being relevant to the subject matter of the invention.

As is known, a single zone HVAC unit may supply conditioned heated or cooled air to more than one distinct zone or room. Each room or zone may have different comfort requirements due to occupancy differences, individual preferences, exterior load differences, or perhaps different zones may even be on different levels, thereby creating different heating or cooling requirements. As is also known, a single zone HVAC unit is named such because it is normally controlled from one thermostat controller. In a building which has more than one zone and whose zones have different heating and cooling requirements, it becomes difficult to choose a good representative location for the controlling thermostat.

Several attempts to solve the problems of controlling the different needs of more than one zone which is provided heating and cooling from a single zone HVAC unit have been tried. Among those tired is control of the air into each zone by a zone damper and a thermostat arrangement with said damper and thermostat opening and closing the air into said zone in response to said thermostat requirements. These dampers suffered many drawbacks, not the least of which is how to coordinate the change from a heating mode to a cooling mode or vice versa when the HVAC control thermostat changes modes of the HVAC unit. Another drawback of using independent zone control dampers and thermostats is that, even though the damper can control the air into each respective zone, it still is at the mercy of the thermostat that is controlling the HVAC unit. This creates a situation in which either some zones require more conditioning but cannot become satisfied because the HVAC unit has cycled off, or the HVAC unit ran needlessly after the zone dampers had satisifed their respective zone requirements prior to the HVAC thermostat having been satisfied. In essence, even though each zone may have its own thermostat, there is still only one thermostat controlling the HVAC unit.

The prior art has not disclosed a system which controls both the HVAC unit and the air distribution of that respective HVAC unit from two or more thermostats, creating a control system which allows a single zone HVAC unit to become a multiple zone HVAC system.

SUMMARY OF THE INVENTION

In accordance with the present invention, there is provided the ability to control a single zone HVAC unit and its air distribution system from a common set of thermostats in two or more zones with each thermostat controlling both the single zone HVAC unit through a monitor control and its own respective zone damper which controls the air flow in its zone which is provided from the HVAC unit, thereby creating an automatic heating and cooling variable air volume and variable temperature control system for single zone HVAC units.

Briefly, the above is accomplished by providing a thermostat, damper and damper control system of the type disclosed in our above noted copending applications in each zone to be controlled. The thermostat controls the damper in its respective zone in the manner set forth in our copending applications noted above. In addition, a signal related to the temperatures sensed by each thermostat and the damper position in each zone is sent to a central monitor system in which the monitor considers the needs of the individual zones, the damper position in each zone, the amount of demand in the zone, mode of the zone dampers and other factors which affect the comfort of zone occupants and control the HVAC unit to provide a desired comfort level in a plurality of zones by the use of a single zone HVAC unit so that it in effect becomes a multiple zone system.

The monitor includes a microprocessor system which assesses various information obtained from each damper thermostat such as the set point of the thermostat, the minimum and maximum stop settings of the damper, the position of the dampers which the thermostat is controlling, the mode (heating or cooling) which the thermostat is in, the room temperature or zone temperature at the thermostat, the duct temperature at the damper assembly which is controlled by the thermostat, the exiting air temperature of the HAVC unit, with all of this information being assessed and stored in the memory of the monitor so that such information can be compared from all of the governor zone thermostats with the switch settings on the monitor and then properly control the HVAC unit.

The monitor can change the HVAC unit from one mode to another with a time delay being provided and information instruction sent to the zone thermostats to enable the individual thermostats to position their respective zone dampers to the positions which will be in harmony with the type of conditioned air the HVAC under control of the monitor is preparing to send through the duct system, with the monitor then energizing the appropriate heating or cooling circuits.

BRIEF DESCRIPTION OF THE DRAWINGS

FIGS. 5A1–5A4 and 5*b*–5*b*3 are a circuit and diagram of the governor monitor circuit;

DESCRIPTION OF THE PREFERRED EMBODIMENT

Figure 1:
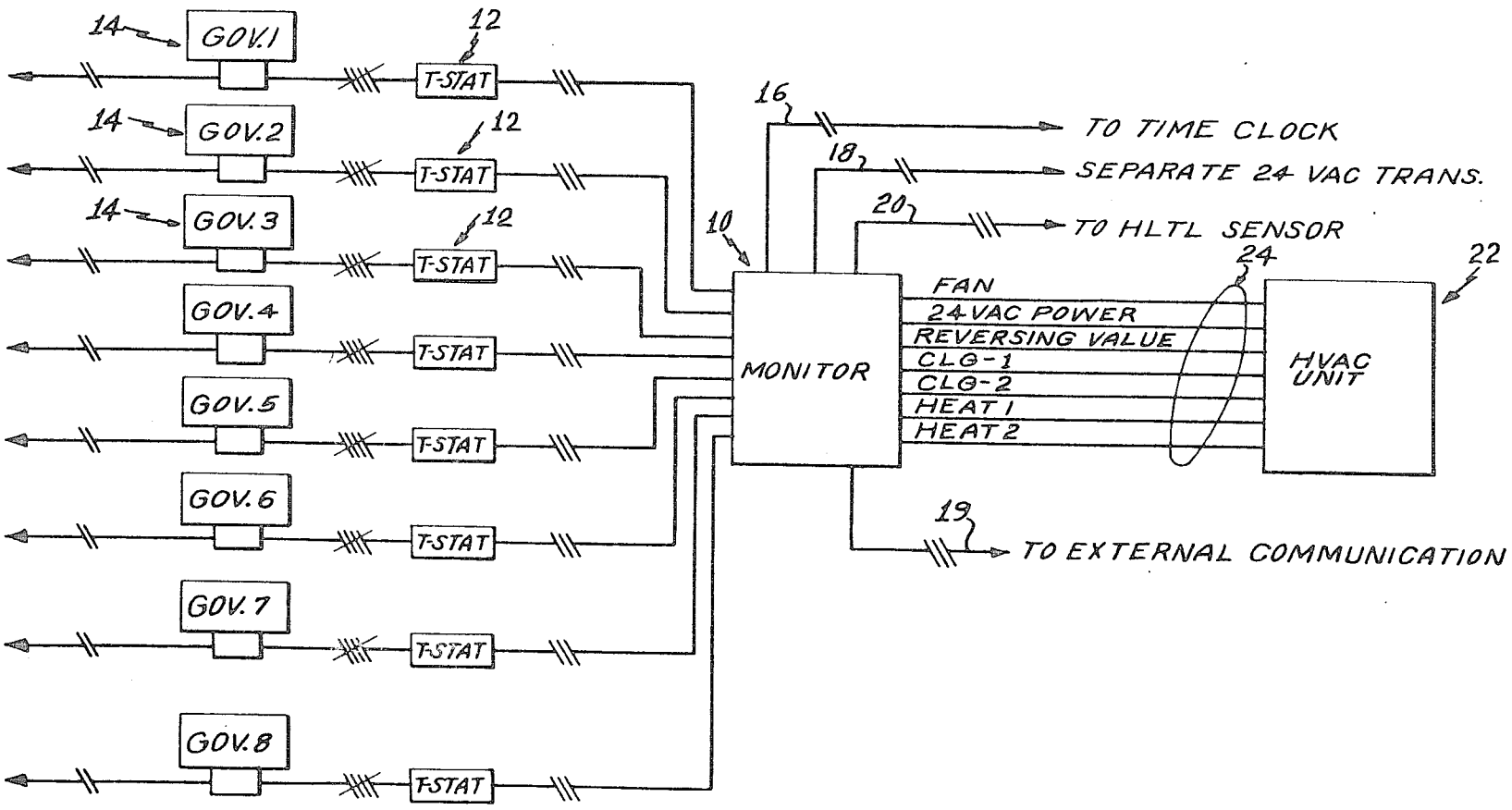
FIG. 1 is a diagrammatic view illustrating the monitor and its assocation with the HVAC unit and its interface with the zone thermostats and zone dampers or governors.
Figure 2:
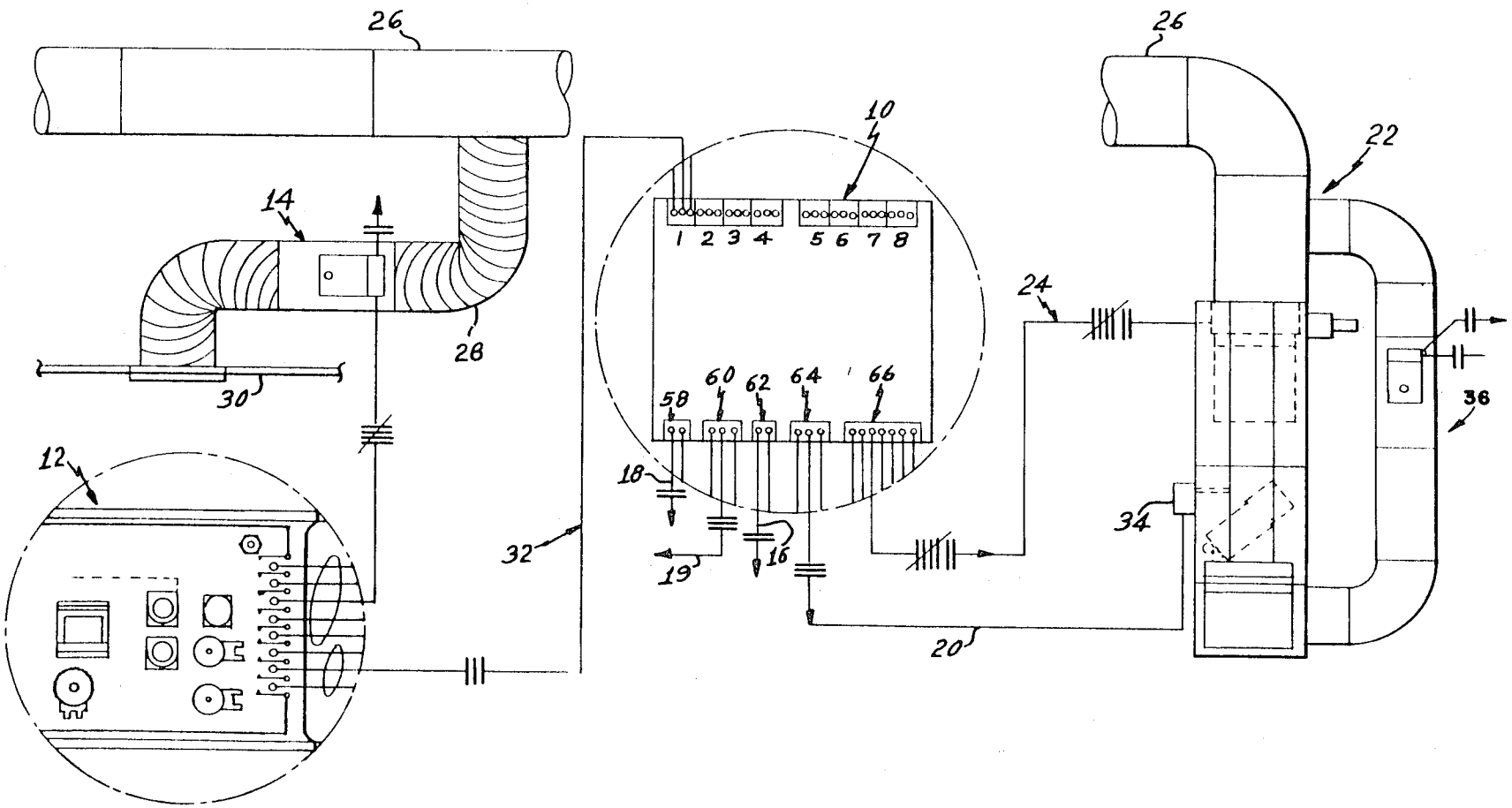
FIG. 2 is a schematic illustration of a typical installation illustrating the mechanical components and the electrical components of the monitor and its association with the zones, damper and HVAC unit.
Figure 4:
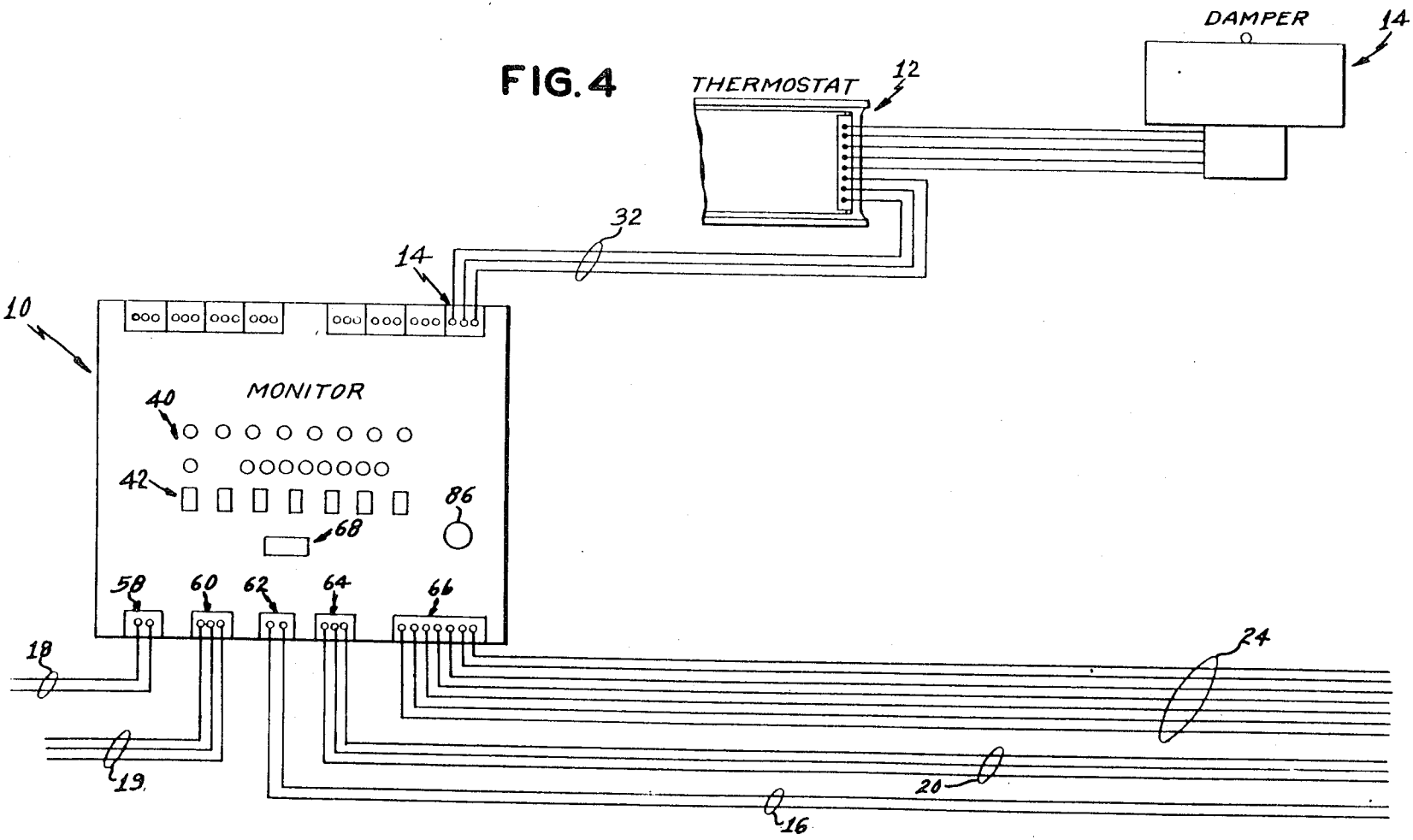
FIG. 4 is a schematic wiring diagram of one of the dampers and other components associated with the monitor.

Referring now specifically to FIGS. 1, 2 and 4, the monitor of the present invention is generally designated by reference numeral 10 and has an electrical connection to each of eight thermostats 12 and damper assemblies or governors 14 with the aforementioned copending applications disclosing the details of the thermostats 12 and the dampers or governors 14. The monitor is electrically connected to a time clock for night setback through line 16, to a transformer of a power supply through line 18 and to a sensor on the HVAC through line 20. Also, the monitor is connected to the HVAC unit generally designated by numeral 22 through a plurality of conductors generally designated by the numeral 24. The monitor is electrically connected for external communication through line 19.

FIG. 2 illustrates the monitor 10 schematically associated with an air supply duct 26 having a branch duct 28 extending into a room or zone 30 with a damper assembly or governor 14 (governor 1 of FIG. 1 as an example) being incorporated therein whih is controlled by a thermostat 12 as illustrated so that the thermostat is also connected to the monitor 10 through line 32. This arrangement discloses the interface between the monitor 10, the HVAC unit and the governor and thermostats with the system including a monitor sensor probe 34 connected to the HVAC unit by lines 20 and a bypass system 36 for the HVAC unit. The bypass system 36 is more specifically described in applicants' copending U.S. application Ser. No. 470,331, filed Feb. 28, 1983.

Figure 3:
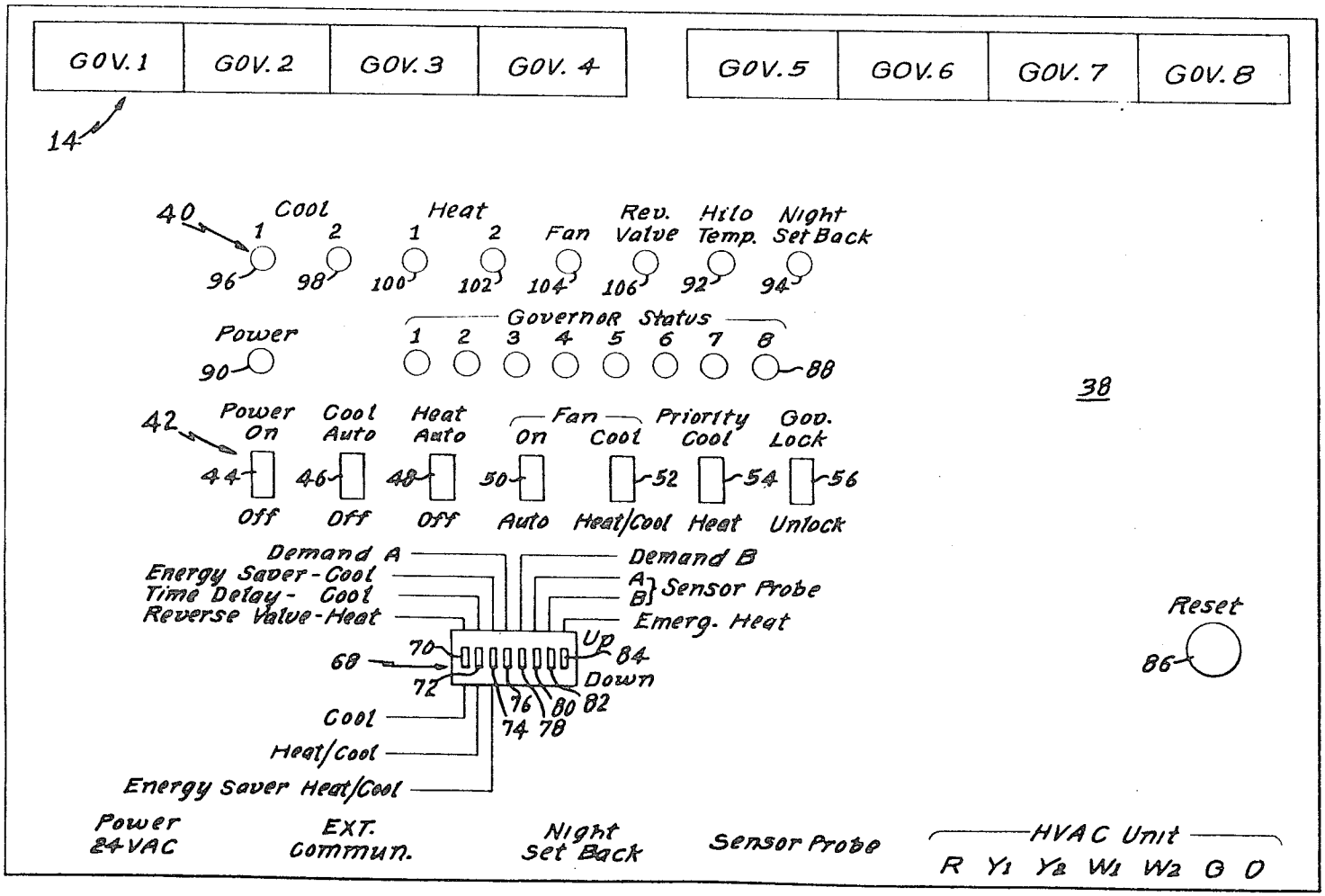
FIG. 3 is a plan view of the control panel incorporated into a cabinet structure forming a portion of the monitor of the present invention.

FIG. 3 discloses a control panel 38 of a cabinet or the like which is shown as part of the monitor 10 including a designated connection for each governor or damper assembly 14 other connection locations as shown in FIG. 2 and various indicator lights 40 and switches 42. The switches 42 include a power switch 44 for turning the power on and off, a cool switch 46 which can be turned off or set on automatic, a heat switch 48 which can be turned off or set on automatic, a pair of fan switches 50 and 52 with the switch 50 having an "on" position and an "automatic" position and the switch 52 having a cool or heat/cool position. Priority switch 54 is provided with a cool or heat position and the GOV. LOCK switch 56 has a lock or unlock position. The light assemblies 40 include an indicator light for the power 90, an indicator light for each governor status 88 and indicator lights 92 to 106 for other conditions as illustrated in the drawing of the control panel 38 as illustrated in FIG. 3.

FIG. 4 illustrates schematically the electrical association between the monitor 10, the thermostat 12 and a governor or damper 14.

The monitor 10 is provided with a power supply (not shown) from a separate 24 VAC transformer through the power supply line 18, as illustrated in FIGS. 1 to 4 and as disclosed in this application. The monitor 10 has the capability of inerfacing with eight governors or dampers 14 and thermostats 12 which are disclosed in detail in the aforementioned copending application with the monitor 10 being wired to the three lower terminals on the thermostat 12, as illustrated in FIG. 4, which are color coded with these wires being connected to the designated areas 14 of the monitor 10 along the top edge thereof. In FIG. 4, the monitor 10 includes terminals 58 to which the power supply is connected through the wiring 18, terminals 60 for external communication, terminals 62 connected to the time clock for night setback through wiring 16, terminals 64 connected to the monitoring sensor probe 34 through wiring 20 and terminal 66 connected to the HVAC unit through wiring 24 with the wiring 24 including a connection to the reversing valve, fan, second heat, first heat, second cool, first cool and a 24 volt control ine as schematically illustrated in FIGS. 1 and 4.

As indicated, each governor or damper location is identified by number and a chart may be provided on the inside of the monitor cabinet door for recording the location of the governors 14 and the governor thermostats 12 are connected to the governors or dampers 14 and connected to the monitor as illustrated in FIGS. 1 through 4. The night setback terminal 62 has a two position terminal strip provided with a jumper wire which, when in place, the monitor set point temperatures are established at the governor thermostats 12. When continuity between the night setback terminals is broken, the monitor will automatically go into the setback mode and the set point temperatures are automatically readjusted to energize the first stage heating at 65° F.; second stage heating at 63° F.; first stage cooling at 85° F.; and second stage cooling at 87° F. The night setback terminal strip 62 is connected to a time clock so that the monitor may be automatically switched from an occupied mode to a night setback mode. This is accomlished by merely running the contacts of the time clock through the two position terminal strip 62 on the monitor panel 38. The time clock may be incorporated into the panel 38 or oriented in any desired location.

The monitor sensor probe 34 is located where it will sense the temperature of both the heating and cooling circuits. In heat pump installations, the probe 34 is located where it can sense the refrigeration circuit only without sensing the resistance heater in the heat pump installation and the probe 34 is electrically connected to the terminal strip 64 which is a three position terminal strip that is also color coded. The HVAC unit is connected to the terminal strip 66 which is a seven position terminal strip which is also color coded with the wiring varying with the HVAC unit and the options used. The external communication terminal 60 and lines 19 therefrom are for use when the monitor is connected to a computer or other optional peripheral control which does not form part of the present invention.

The power switch 44 is used to energize or de-energize the monitor 10. The cool switch 46 can be moved to an "off" position in which a call for cooling will not energize the cooling relay in the monitor but when the switch 46 is in the "auto" position, a call for cooling will energize the cooling relay or relays in the monitor. A call for first stage cooling occurs when the temperature at a governor thermostat 12 is 2° F. above set point and second stage cooling is called for when the temperature at a governor thermostat is 3° F. above set point.

The switch 48 can be set at the "off" position where a call for heating will not energize the heating relays or it can be moved to an "auto" position where a call for heating will energize the heating relays. A call for first stage heating is when the room temperature at a governor thermostat 12 is 2° F. below set point and second stage heating is when the room temperature at a governor thermostat is 3° F. below set point. When both the cool switch 46 and heat switch 48 are in the "auto" position, the monitor 10 will operate with automatic heating/cooling changeover.

The fan switches 50, 52 can be oriented with the switch 50 in the "on" position in which the fan relay will be energized continuously and in the "auto" position in which the fan relay will be energized on a call for cooling only or on a call for heating or cooling depending upon the setting of the switch 52 which can be moved from a cool position or a heat/cool position. When the switch 52 is in the "cool" position and the switch 50 is in the "auto" position, the fan will run only on a call for cooling. When the switch 52 is in the "heat/cool" position and the switch 50 is in the "auto" position, the fan will run on a call for heating or a call for cooling.

The priority switch 54 determines whether the system operates in a cooling or heating mode when an equal number of governor themostats call for cooling and heating at the same time. For example, if two governor thermostats call for cooling and two call for heating and the priority switch 54 is in the "cool" position, the operating mode of the system will be cooling, whereas, if an equal number of governor thermostats call for cooling and heating and the priority switch 54 is in the "heat" position then the system will be in a heating mode. After the priority mode has been satisfied, the monitor may operate in the opposite mode if there is sufficient demand.

The governor lock switch 56 can be set in the "locked" position in which all set point temperatures at the governor thermostats 12 are locked and cannot be changed and they will remain at the temperature as set. When the switch 56 is in the "unlocked" position, the set point temperatures of the governor thermostats 12 may be adjusted within the temperature range of the thermostat (68° F. to 81° F.).

The monitor panel 38 is also provided with a plurality of switches 68 as illustrated in FIG. 3 with eight switches being incorporated into the group and including a reverse valve switch 70, a time delay switch 72, an energy saver switch 74, demand switch A 76, demand switch B 78, a monitor sensor probe switch A 80, a monitor sensor probe switch B 82 and an emergency heat switch 84. These switches coordinate the function of the HVAC unit with the particular installation requirements and each of these switches is numerically identified and can be moved between an "up"-and-"down" position. The reverse valve switch 70 may be used in heat pump applications with external reversing valve circuits. The switch 70 determines the mode in which the reversing valve relay is energized. With the switch 70 in the "up" position, the reversing valve relay is energized in the heat mode and in the "down" position, the reversing valve relay is energized in the cool mode. The time delay switch 72 is a protective switch which prevents short-cycling of the equipment in that it provides for a five minute delay when the monitor is first energized on initial start-up, after a power interruption or during normal operation after each stage of a mode has been de-energized. When the time delay switch 72 is in the up or cool position, the delay occurs only in the cooling mode and when the switch 72 is in the down, heat/cool position, the delay occurs in both the heating and the cooling mode.

The energy saver switch 74 is used only with night setback options and when it is in the up, cool position, second stage cooling, only, is not energized for 20 minutes after the night setback time clock returns to the day mode of operation. When the switch 74 is in the down, cool/heat position, both second stage cooling and second stage heating are not energized for 20 minutes after the night setback time clock returns to the day mode of operation. The down position is used for heat pump applications where electric heat is used to provide second stage heating.

The demand switches 76 and 78 determine the number of governors that have to be calling for heating or for cooling at the same time before heating or cooling is energized at the HVAC. If both demand switches 76 and 78 are down, one governor must be calling for heating or cooling in order to energize the heating or cooling operation. When switch 76 is in the up position and switch 78 is in the down position, two governors must demand heating or cooling in order to energize the heating and cooling operation. When switch 76 is down and switch 78 up, three governors are required and when both switches are up, four governors are required to demand heating or cooling before the heating and cooling operation will be energized. The monitor sensor probe switches 80, 82 are associated with the sensor probe 34 which is a limit control that provides high and low temperature limit protection for the HVAC unit and is applicable only when the monitor sensor probe option is being used. The use of this feature makes it possible to vary the limit settings, thereby making it possible to use the monitor sensor probe with various HVAC equipment or vary the method of sensing, such as air temperature or refrigerant gas temperature. If the sensor probe 34 is not connected to the monitor, both of the sensor probe switches 80, 82 must be in the down position. The monitor will automatically de-energize all HVAC circuits if the monitor sensor probe is not attached with either of the monitor sensor probe switches in an up position. When the temperature limits are exceeded at the monitor sensor probe, the monitor will turn off the relay which corresponds to the trip temperatures found on a monitor sensor probe table and when the temperature returns to within the limit setting, a five minute delay is initiated before that particular stage may be re-energized.

When the probe 34 is used to sense air temperature in a heat pump installation, the switch 80 is up and switch 82 is down with the trip temperatures in the heating system being 108° F. in the first stage and a cooling trip temperature being 45° F. in the first stage and 50° F. in the second stage. When used with a heat pump for sensing refirgerant temperature, both switches are up and the trip temperature for the first stage of heating is the same and the cooling temperature trip points are 32° F. in the first stage and 38° F. in the second stage. In a gas/electric system and when sensing air temperature, the switch 80 is down and the switch 82 up and in this mode, the trip temperature in heating is 160° F. in the first stage and 140° F. in the second stage and in the cooling stages, the trip temperature is 45° F. in the first stage and 50° F. in the second stage.

The emergency heat switch 84 provides for normal function of the first and second stage heating when in the down position. When in the up position, first stage heating is locked out and only second stage heating will operate normally.

The monitor panel 38 is also provided with a reset button 86 which, when depressed, will reduce the time delay function from five minutes to approximately one and one-half minutes and automatically reset all functions of the monitor.

As illustrated in FIG. 3, the light array 40 includes governor status lights 88 which are numerically numbered for identification and are a distinguishable color such as green so that when any one of the lights 88 is off, that particular governor is not connected or is not functioning properly. When a particular green light 88 is on continuously, the governor thermostat is not calling for heating or cooling. If the light 88 is blinking slowly, the governor thermostat is calling for cooling, and if the light 88 is blinking rapidly, the governor thermostat is calling for heating. Alongside but spaced from the governor status lights 88 is a power light 90 which indicates that the unit is energized when it is on. Located above the power light 90 and the governor status lights 88 is a red high/low temperature light 92 which will be illuminated when a monitor sensor probe 34 is attached to the monitor. When the sensor probe senses a temperature above the high set point limit as established by the probe switches 80, 82, the light 92 will blink rapdily. When the probe senses a temperature below the low set point limit as established by the switches 80, 82, the light 92 will blink slowly. Alongside the light 92 is a night setback light 94 which is illuminated when the monitor is operating in the night setback mode. HVAC indicator lights 96, 98, 100 and 102 are illuminated when first stage cooling, second stage cooling, first stage heating and second stage heating are energized. Also fan light 104 and reversing valve light 106 are illuminated when the fan or reversing valve circuits are energized. All of the lights except for the governor status lights are red so that they may be distinguishable from the governor status lights which are green.

As set forth previously, the monitor permits up to eight individual computerized zone control thermostats to control the HVAC unit thereby providing a zone control system which is economical in cost and easy to use and install. As disclosed, the system provides control of a single zone HVAC unit and renders it feasible to control up to eight different zones or locations in which each zone is continuously air balanced by the thermostat and damper assembly associated with each zone as disclosed in detail in the aforementioned applications which are incorporated herein by reference thereto. The monitor considers individual zones as to its needs, damper position, demand in the zone, mode of the zone damper and other factors which affect the comfort of the zone occupants with the monitor deciding how and when to control the HVAC unit so that the single zone HVAC unit actually becomes a multiple zone system. The monitor in each given time increment, such as 10 seconds, will communicate with up to eight governor thermostat assemblies and will access six pieces of information including (1) the set point of the governor thermostat; (2) the minimum and maximum damper stop settings at the governor thermostat; (3) the position of the dampers which the governor thermostat is controlling; (4) the mode, heating or cooling, which the governor thermostat is in currently; (5) the ambient (room) temperature at the governor thermostat; and (6) the duct temperature at the damper assembly which the governor thermostat is controlling. This information is stored in the memory of the monitor system. The monitor then compares the information which has been received from the governor thermostats with the switch settings on the monitor and appropriate action or actions are taken. If there is sufficient demand at the governor thermostats to initiate the cooling or heating circuits, the monitor will first change the mode, if necessary, (heating or cooling) of the governor thermostats to the mode which the monitor is preparing to energize before actual energization takes place. After the monitor changes the mode of the governor thermostats, there is a time delay which gives the governor thermostats time to position their respective zone dampers to the positions which will be in harmony with the type of conditioned air the monitor is preparing to send through the duct system. After this delay, the monitor then energizes the heating or cooling circuits.

For example, the monitor will recognize that enough governor thermostats call for cooling in accordance with the previous explanation. The monitor will change the mode of all of the governor thermostats to the cooling mode and provide a one minute delay in order to give the dampers time to be positioned after which the appropriate stages of cooling are energized.

The foregoing arrangement provides for appropriate control of a single zone HVAC unit from a plurality of zones with each zone including a damper assembly (governor) and a thermostat with each governor thermostat controlling the HVAC unit in accordance with the switch positions and other predetermined parameters of operation.

The above is accomplished utilizing the electronic circuits described hereinbelow in conjunction with the monitor firmware.

Figure 5B:
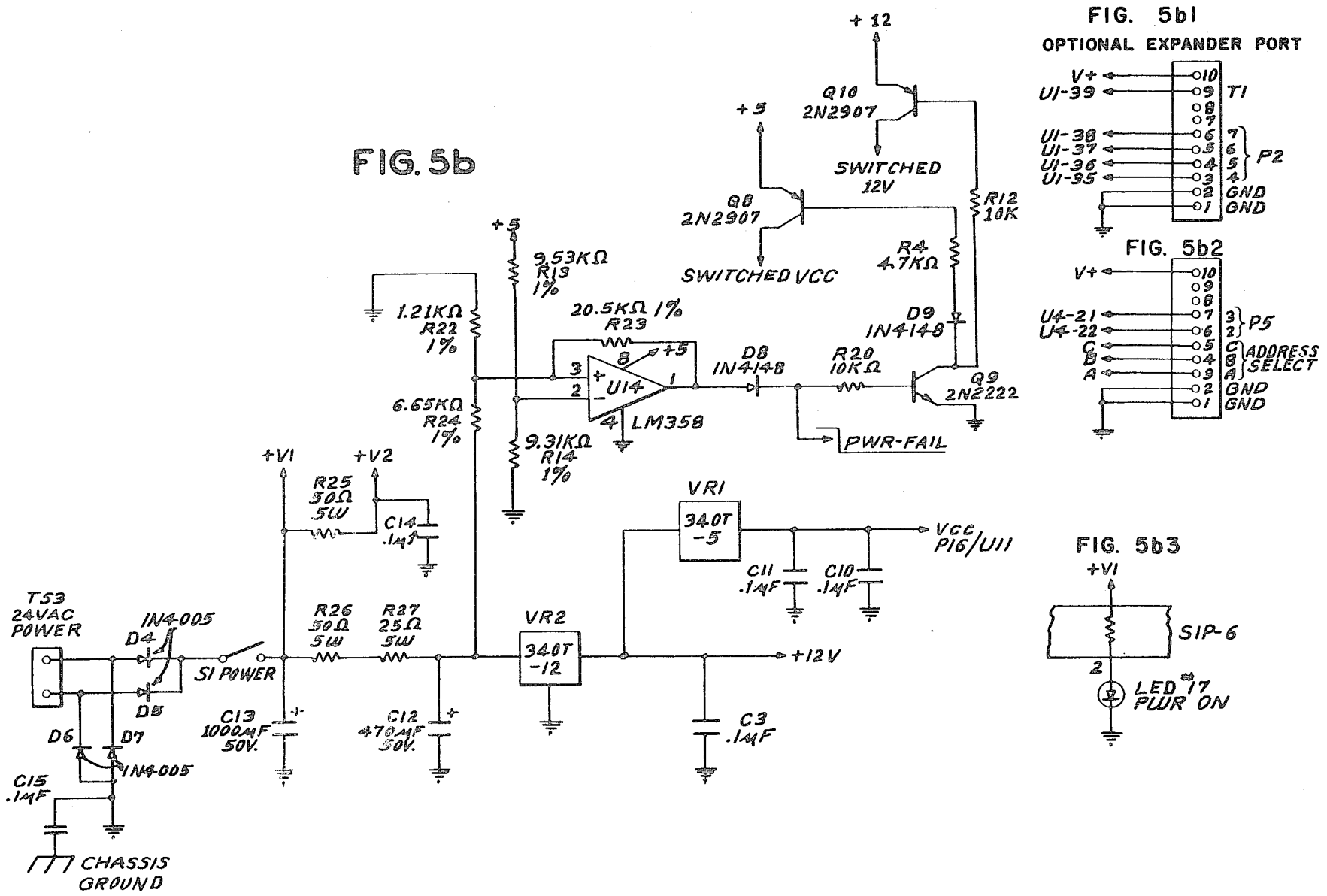

Referring now to FIG. 5, there is shown the electronic circuitry contained in the monitor which is connected to the lines entering the monitor as shown in FIGS. 1, 2 and 4 and which operates under control of the switches shown in FIG. 3 which are disposed on the front face of the monitor in the preferred embodiment. The circuitry includes a microprocessor device U1 and a program memory U2 which stores the programmed memory therein in the form of instruction codes to be executed by the microprocessor U1. In the preferred embodiment, the program stored in the memory U2 is in machine language. A latch U3 is positioned to transfer address data from the microprocessor U1 to memory U2. During an instruction fetch, microprocessor U1 will place the lower address bits on the data buss corresponding to pins 12 through 19 thereon and will place the upper address bits on the lower nibble of port 2 which comprises pins 21 through 24. The lower address bits will appear at the input of the octal latch U3. When microprocessor U1 strobes ALE on pin 11 thereof, the address bits will be latched into latch U3. Microprocessor U1 will then restore the data buss pins 12 through 19 of microprocessor U1 and all address bits will appear at the inputs of memory U2. When microprocessor U1 then strobes PSEN on pin 9 thereof, the address instruction located in the memory U2 will be placed on the data busses composed of pins 9 through 17 of the memory U2. This instruction is transmitted to pins 12 through 19 of microprocessor U1 and, once the instruction is stored internally in microprocessor U1, the microprocessor will restore the data busses and port 2 to its original condition. The microprocessor U1 provides a clock frequency of 6 MHz, this being determined by the crystal Y1 and the capacitors C1 and C2 which are connected to pins 2 and 3 of the microprocessor and provide the clock frequency. Also shown connected to pin 6 of the microprocessor U1 is a reset switch S16 which is connected to the interrupt input. Operation of this switch makes possible different system behavior after a user reset and power-up reset. Switch S16 corresponds to the reset button 86 in FIG. 3.

Referring again to FIG. 5, there are shown a plurality of panel switches S1 through S7 which correspond to the even numbered switches 46 through 56 in FIG. 3. Also shown are dip switches S8 through S15 which correspond to the even numbered switches 70 through 84 of FIG. 3. Further shown is the night set-back terminal TS5 of FIG. 5 which corresponds to the night set-back switch 62 in FIG. 3 and the HLTL sensor terminal TS6 of FIG. 5 which corresponds to the sensor probe terminal 64 of FIG. 3. These inputs corresponding to switches S2 through S15, night set-back terminal TS5 and sensor terminal TS6 are selected and read one at a time by two C-MOS one of eight data selector units U11 and U12. Selector U11 selects the dip switches addressed by a three bit code which microprocessor U1 places on selector U11 inputs 9, 10, 11 from terminals 27, 28 and 29 of the microprocessor. If microprocessor U1 places a low signal on inhibit terminal 6 of selector U11 from terminal 33 of the microprocessor, the status of the select switch will appear at terminal 38 of microprocessor U1, having been transmitted from I/O terminal 3 of selector U11.

Selector U12 shares the same address bits as selector U11, receiving them on terminals 9, 10 and 11 thereof and therefore selects one of the panel switches S2 through S7, the night set-back input or the sensor probe input, depending upon the address. When the inhibit input 6 of selector U12 is brought low, selector U12 will send the status of the selected switch/input to the T1 input at pin 39 of microprocessor U1 from the I/O terminals at pin 3 of the selector U12.

An open circuit at the night set-back input TS5 will cause transistor Q3 and transistor Q11 to be turned off. This allows night set-back status LED 16 corresponding to lamp 94 in FIG. 3 to be turned on and the pin 2 input of selector U12 to be low. Closing the input circuit of night set-back TS5 will cause both transistors Q3 and Q11 to conduct, turning off the LED 16 and causing the input at pin 2 of selector U12 to go high. The sensor probe connected at TS6 provides a constant current pulse output whose width is determined by the probe temprature. Resistor R7 serves as a load to convert the current into voltage. When the pulse is high, transistor Q2 conducts and brings the pin 4 of selector U12 low. When selected and enabled, the pulse from the sensor will appear at the T1 input at pin 39 of microprocessor U1 which then measures the pulse width and establishes the temperature of the probe therefrom.

The input signals from the governors GOV 1 through GOV 8 at the monitor 38 as shown in FIGS. 1 through 4 correspond to the inputs labelled GOV 1 through GOV 8 shown in FIG. 5. The operation on signals received from the governors or thermostats and signals transmitted thereto from the monitor in conjunction with the electronic circuit of the monitor will now be discussed. The circuit includes a level translator U10, a transmit multiplexer U7, a receive multiplexer U8, and a line driver U9 and thereby interfaces the eight governor communication ports to the microprocessor U1. The translator U10 has its input pins to the left thereof connected to pins 27 through 32 of microprocessor U1. Translator U10 inverts the outputs of the microprocessor which swing from zero to five volts and makes the signals swing from zero to twelve volts for compatability with the driver U9 output ports at the right of U9. At the output pins of translator U10, the lowest order bits at pins 8, 6 and 10 are the complement of the governor to thermostat to be selected. Pin 4 of the translator provides the serial data to the selected governor whereas pin 12 of the translator disables the line driver U9 when appropriately energized. Pin 2 of the translator goes low to enable both multiplexers U7 and U8. Since the address is complemented, the order of connection to the multiplexers has been mirror imaged to compensate therefor. To send data to a governor or thermostat, the address of the governor is provided from microprocessor U1 followed by a multiplexer enable and line driver enable signals on lines 12 and 2 of the translator U10. A low signal on pin 30 of the microprocessor U1 causes the selected "COM" Data line on TS4 to go high whereas a high signal on pin 30 causes the selected "COM" Data line to go low. After the data has been sent from the translator U10, microprocessor U1 disables the line driver and allows a response to return over the same wire. With the address and multiplexer enable signals still intact, the response data is routed through multiplexer U8 and is attenuated by a diode network composed of diodes D1 through D3 and resistor R2. This network shifts logic levels from twelve volts back to five volts. The data is then fed to pin 39 of the multiplexer U1.

A sixteen bit port expander U4 provides the microprocessor U1 with more output capability. Pins 13 through 20 of port expander U4 drive the eight governor status LEDs 1 through 8 which correspond to the governor status lamps 88 shown in FIG. 3 via a Darlington array U6 and one Darlington from U5. Pin 21 of port expander U4 drives the high-low temperature status LED 15 through transistor Q1. Port expander U4 pins 1 through 5 and pin 23 drive the six HVAC control relays and relay status LEDs 9 through 14 through the remaining Darlington circuits of U5. Pin 9 of Darlington circuit U5 is connected to the power source of the relays K1 through K6. The Darlington circuits are internally connected to suppression diodes which are part of U5 (not shown) and serve to limit transient voltages developed when the magnetic field of a relay collapses as it is de-energized. Metal oxide varistors MV1 through MV6 shunt the relay contacts and provide protection against voltage kick-back from external inductive loads.

An electrically isolated serial data communication, "COM", port TS4 is made up of transistors Q6 and Q7 and optical isolator circuits U15 and U16. A high from the "COM" Data line on the center terminal of TS4 turns on isolator U16 and causes the TO input at pin 1 of the microprocessor U1 to go low. The "COM" Data line returning to low turns off isolator U16 and makes input TO at pin 1 of microprocessor U1 to return high. To respond, microprocessor U1 will pull pin 34 thereof low which turns on transistor Q7 and isolator U15 and transistor Q6, forcing the "COM" Data line high. Returning pin 34 of microprocessor U1 to high level returns the "COM" Data line low.

Power is supplied by external twenty-four VAC source connected to terminal TS3. Capacitor C15 bypasses line noise to chassis ground. Power is rectified by the diodes D4 through D7 and filtered by capacitor C13 which is shown following the power switch S1 which corresponds to switch 44 on the panel 38 of FIG. 3. Power switch S1 interrupts current flow when it is turned off. The filtered DC voltage at capacitor C13 is dropped by resistors R26 and R27 and presented to the input of regulator VR2. Regulator VR2 provides plus twelve volts DC to the governor interface and to the input of voltage regulator VR1 which supplies plus five volts DC to the remaining logic. Filter capacitor C13 also supplies the status LEDs and the relays through dropping resistor R25 with voltages labelled as V1 and V2. Operational amplifier U14 is connected to detect insufficient input voltage caused by brownouts at the regulators, power glitches, power up, etc. When amplifier U14 triggers, it will reset the microprocessor U1 by temporarily discharging reset capacitor C8 at pin 4 of the microprocessor U1 through the power fail output from amplifier U14 and transistors Q4 and Q5. Amplifier U14 also resets port expander U4 by removing power therefrom through transistors Q8 and Q9. This ensures that the relays K1 through K6 will be off during a brownout or power interruption. Also, during this condition, transistor Q10 will remove plus twelve volts from the governor interface circuitry.

Figures 6A, 6B:
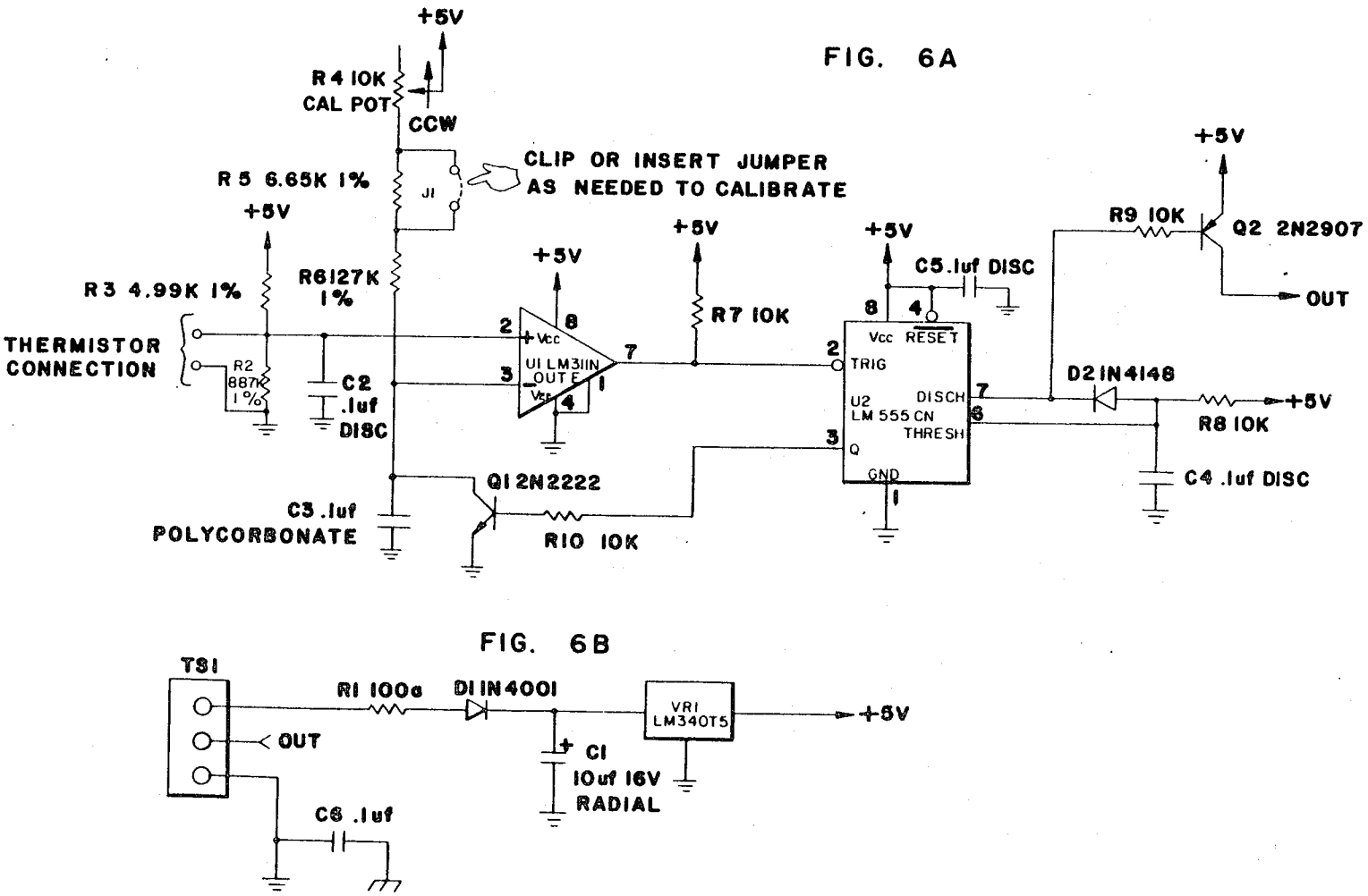
FIGS. 6A and 6*b* is a circuit diagram of the monitor sensor probe circuit.

Referring now to FIG. 6, there is shown the details of the monitor sensor probe 34 as shown in FIG. 2. The monitor sensor probe circuitry measures temperature and provides an output compatible with the microprocessor U1. Basically, the monitor sensor probe is a pulse width modulator controlled by the voltage developed across a thermistor (not shown). The thermistor is connected to a resistor network composed of resistors R2′ and R3′. The resistor network provides a voltage output that is a function of the thermistor temperature. Monostable multivibrator U2′, comparator U1′, transistor Q1′ and capacitor C3′ and charging resistors R4′, R5′ and R6′ form an astable multivibrator circuit. When multivibrator U2′ is inactive, transistor Q1′ allows capacitor C3′ to be charging at a rate determined by calibrated potentiometer R4′ and resistors R5′ and R6′. When the voltage at capacitor C3′ equals the thermistor network voltage, comparator U1′ output goes low, triggering multivibrator U2′ into the active state. Therefore, the length of time that multivibrator is not active depends on the thermistor temperature. The exponential nature of the charging curve of capacitor C3′ tends to cancel the logarithmic characteristic of the network voltage function over the target temperature range. Output buffer Q2′ is tied through resistor R9′ to the discharge pin 7 of the multivibrator U2′. Transistor Q2′ is off when multivibrator U2′ is active and on when multivibrator U2′ is inactive. Diode D2′ serves to isolate the base drive current from timing component composed of resistor R8′ and capacitor C4′. The length of time that the collector of transistor Q2′ pulls high is determined by the thermistor temperature and the length of time that it is in the hi-2 state depends upon the value of the dead time components composed of capacitor C4′ and resistor R8′ which are set at about 1.1 milliseconds. In actual use, the output buffer transistor Q2′ will drive a current sink or load resistor reference to ground, thus providing a pulse with an amplitude of five volts. The circuit is calibrated by adjusting resistor R4′ so that the pulse width will be equal to 9.00 milliseconds plus or minus 7.5 microseconds at 77° F. The pulse output of this device is fed into and tested by input line T1, pin 39 of the microprocessor U1. The particular processor selected to interface with the monitor sensor probe has a cycle time of 2.5 microseconds. A pulse width counter routine is implemented utilizing increment, test and jump instructions for a total of 7.5 microseconds per count.

To find the number of counts, simply divide the pulse width by 7.5 microseconds. In order to determine the pulse width, however, it will first be necessary to find the thermistor network voltage (Vnet). This may be done by reading the expected thermistor resistance (Rt) from the resistance vs. temperature chart for a curve 1 NTC device and plugging it into the network equation:

$$Vnet = Vcc/[R3[1/Rt + 1/R2] + 1]$$

where:

Vcc = Supply voltage (+5 Volts)
R3 = 4.99k ohms
R2 = 8.87K ohms
Rt = Thermistor resistance Once the voltage has been established, the pulse width (tpw) can be found using:

$$\text{tpw} = \text{LOG } n[1/[[1 - Vnet/Vcc] \uparrow RC]]$$

where:

Vnet = thermistor network voltage
Vcc = supply voltage (+5 Volts)
C = 0.1 microfarad
R = 135.601K ohms (the normalized value of R4, 5 and 6)

Combining the two above expressions yields:

$$tpw = \text{LOG } n[1/[1 - [Vcc/[R3[1/Rt + 1/R2] + 1]/Vcc]] \uparrow RC]$$

Cancelling out two redundant terms brings forth:

$$tpw = \text{LOG } n[1/[[1 - 1/[R3[1/Rt + 1/R2] + 1]] \uparrow RC]]$$

From here it can be seen that in a theoretical sense the supply voltage has no effect on the output pulse width. Although in reality small dissipation factors may become involved making it desirable to maintain a constant supply voltage. This is done with regulator VR-1.

Other support components include capacitor C2′ which rejects normal mode noise picked up by the thermistor connection wires. Capacitor C5′ is a power supply bypass capacitor and stabilizes the five volt source at comparator U1′ and multivibrator U2′. Capacitor C6′ shunts common road noise to chassis ground. Resistor R1′, diode D1′ and capacitor C1′ form an input power filtering network with protection against accidental polarity reversal.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. In a control system for monitoring and controlling the condition of air in each of a plurality of zones when using a single zone HVAC unit having a single supply air duct through which cool air or heated air is delivered into each zone, a thermostat means in each zone interfaced with and controlling a damper means in a duct supplying conditioned air to its respective zone and providing information to a control means, said control means including a monitor having a plurality of selectable control switches, said monitor being interfaced with the HVAC unit, each said thermostat means determining the condition of the air in its associated zone, said monitor activating the HVAC unit in accordance with the selected switches and the information provided from said zone theremostats to control the HVAC unit in the heating mode or cooling mode or ventilating mode.

2. In the system as defined in claim 1 wherein said monitor includes indicating means indicative of the status and requirements of each zone as provided by the information from said thermostat means therein.

3. In the system as defined in claim 1 wherein said monitor includes indicating means indicative of the status of the operating conditions of the HVAC unit.

4. In the system as defined in claim 1 wherein said monitor includes a sensor for sensing the temperature of the heating and/or cooling circuits of the HVAC unit and having an indicating means indicative of the status of the operating conditions of the HVAC unit, said sensor providing information to said monitor for controlling the high and low temperture limits for the HVAC unit.

5. In the system of claim 4 wherein said monitor includes status indicating means for each said thermostat means and said HVAC unit and said sensor probe.

6. In the system as defined in claim 1, wherein said monitor provides information to each said thermostat means as to the heating mode or cooling mode or ventilating mode which in turn controls the positioning of respective said damper means in the selected mode before operation of the HVAC unit in the selected mode.

7. In a control system for a single zone HVAC unit having a single supply air duct through which cool air or heated air is delivered to maintain desired temperature conditions in a plurality of zones in which each zone includes a thermostat and a damper assembly to control the conditioned air to respective said zones, said system comprising a monitor interfaced with the HVAC unit and each said thermostat and damper assembly, said monitor including a plurality of selectable switches for controlling the operation and performance characteristics of the HVAC unit in accord with the switches selected, said monitor receiving information from each thermostat and analyzing such information in accord with the switches selected before operating the HVAC unit in the heating, cooling or venitlating mode.

8. In the system of claim 7 wherein said monitor provides information to each said thermostats as to the selected mode which in turn position said dampers in the selected mode before operating the HVAC unit.

9. In the system as defined in claim 7 wherein said monitor includes a sensor for sensing the temperature of the heating and/or cooling circuits of the HVAC unit and having an indicating means indicative of the status of the operating conditions of the HVAC unit, said sensor providing information to said monitor for controlling the high and low temperature limits of the HVAC unit.

10. In the system of claim 9 wherein said monitor includes status indicating means for each said thermostat and the HVAC unit and said sensor probe.

11. A control system for monitoring and controlling the condition of air within each of a plurality of zones when using a single zone HVAC unit comprising:

(a) a governor thermostat associated with each of said zones, (b) means associated with each zone controlled by the governor thermostat for controlling the flow of air into its respective zone, (c) monitor means responsive to signals indicative of the condition of the air in each of said zones controlling the state of said HVAC unit, said monitor means including (d) means responsive to the mode of said HVAC unit and said signals indicative of the condition of the air in each of said zones to control each said governor thermostat.

12. A control system as set forth in claim 11 wherein said monitor means is responsive to signals received from each said governor thermostat.

13. A control system as set forth in claim 12 wherein said monitor means includes a data base and said means responsive is further responsive to said data base.

14. A control system as set forth in claim 13 wherein each said governor thermostat includes a microprocessor, means in said governor thermostat for providing data to said microprocessor and means responsive to signals received from said monitor means to control said microprocessor.

15. A control system as set forth in claim 12 wherein each said governor thermostat includes a microprocessor, means in said governor thermostat for providing data to said microprocessor and means responsive to signals received from said monitor means to control said microprocessor.

16. A control system as set forth in claim 11 wherein said monitor means includes a data base and said means responsive is further responsive to said data base.

17. A control system as set forth in claim 11 wherein each said governor thermostat includes a microprocessor, means in said governor thermostat for providing data to said microprocessor and means responsive to signals received from said monitor means to control said microprocessor.

18. A control system as set forth in claim 16 wherein each said governor thermostat includes a microprocessor, means in said governor thermostat for providing data to said microprocessor and means responsive to signals received from said monitor means to control said microprocessor.

19. A method for controlling the positioning of a plurality of dampers of zone duct damper means prior to activating a single zone HVAC unit that supplies heated or cooled conditioned air through a single duct system having duct damper means and ducts to a plurality of zones and zone thermostats associated with respective dampers comprising the steps of:

A. determining the demand for heating or cooling from all zone thermostats;

B. selecting the heating or the cooling mode depending on such demand and setting all zone thermostats in the selected mode;

C. closing appropriate dampers if the zone thermostats controlling such appropriate dampers have no demand or demand a mode different than the mode selected to step B, and positioning open the other dampers;

D. activating the HVAC unit in the selected mode until all zone thermostats demanding the selected mode have been satisfied;

E. deactivating the HVAC unit; and

F. repeating steps A–E for the other mode when demand for the other mode has been selected in accord with steps A and B.

20. The method of claim 19 wherein step C includes the step of partially opening some of the other dampers depending upon the amount of demand by their respective thermostats and modulating such dampers between open and closed until the demand is satisfied.

21. The method of claim 20 further comprising the step of

G. comparing such demand from step A with the selectable mode setting of a monitor means controlling all of the zone thermostats and the HVAC unit and selected for heat or cooling prior to step B, and if the demands for heating and cooling are equal, the HVAC unit will be activated in step D in the mode setting of the monitor means.

22. The method of claim 19 further comprising the step of

G. modulating between open and closed positions the zone dampers according to the respective control of the zone thermostats when there is insufficient demand to require activation of the HVAC heating or cooling circuits by the zone thermostats from step A.

23. The method of claim 22 wherein the respective control of the zone thermostats in step G includes the steps of:

a. determining the zone temperature, b. determining the duct temperature of the air in the supply duct, and c. comparing the zone temperature to the duct temperature and (1) when the duct temperature is warmer than the zone temperature, the thermostat operates the zone duct damper in the heating mode and substantially opens the zone duct damper upon the thermostat sending a zone demand for heat when the zone temperature is a predetermined amount below set point and substantially closes the zone duct damper upon the thermostat sensing no zone demand or a zone demand for cooling, and (2) when the duct temperature is cooler than the zone temperature, the thermostat operates the zone duct damper in the cooling mode and substantially opens the zone duct damper upon the thermostat sensing a zone demand for cooling when the zone temperature is a predetermined amount above set point and substantially closes the zone duct damper upon the thermostat sensing no zone demand or zone demand for heat.

24. A method of monitoring and controlling the condition of air within each of a plurality of zones being supplied with heated or cooled conditioned air from a single zone HVAC unit via a single duct system having zone ducts and zone duct damper means therein controlled by zone thermostats and a monitor means monitoring and controlling all zone duct thermostats and the HVAC unit comprising the steps of:

A. setting the set point of each of the zone thermostats to the comfort level of the respective zone occupants;

B. monitoring the demand for heating or cooling from all zone thermostats by the monitor means which selects either of the heating or cooling mode of the HVAC unit;

C. positioning the zone duct damper means open if the zone thermostats are demanding the selected mode and closed for the other damper means;

D. activating the HVAC unit by the monitor means in the selected mode until all zone thermostats demanding the selected mode have been satisfied; and E. deactivating the HVAC unit.

25. The method of claim 24 further comprising the steps of

F. selecting the mode for operation of the HVAC unit in step B in accord with the greater number of zone thermostats demanding cooling or heating;

G. modulating between open and closed positions the zone dampers according to the respective control of the zone thermostats when there is insufficient demand to require activation of the HVAC heating or cooling circuits by the zone thermostats from step A.

26. The method of claim 24 further comprising the step of

F. repeating steps B–E for the other mode when demand for the other mode has been selected in accord with step B.

27. The method of claim 24 wherein step C includes the step of

F. partially opening some of the damper means depending upon the amount of demand for the selected mode by their respective thermostats and modulating such damper means between open and closed until the demand is satisfied.

28. The method of claim 24 further comprising the step of

F. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step D in the mode setting of the monitor means.

29. The method of claim 24 further comprising the step of

F. modulating between open and closed positions the zone damper according to the respective control of the zone thermostats when there is insufficient demand to require activation of the HVAC heating or cooling circuits by the zone thermostats.

30. The method of claim 29 wherein the respective control of the zone thermostats in step F includes the steps of:

a. determining the zone temperature, b. determining the duct temperature of the air in the supply duct, and c. comparing the zone temperature to the duct temperature and (1) when the duct temperature is warmer than the zone temperature, the thermostat operates the zone duct damper in the heating mode and substantially opens the zone duct damper upon the thermostat sending a zone demand for heat when the zone temperature is a predetermined amount below set point and substantially closes the zone duct damper upon the thermostat sensing no zone demand or a zone demand for cooling, and (2) when the duct temperature is cooler than the zone temperature, the thermostat operates the zone duct damper in the cooling mode and substantially opens the zone duct damper upon the thermostat sensing a zone demand for cooling when the zone temperature is a predetermined amount above set point and substantially closes the zone duct damper upon the thermostat sensing no zone demand or zone demand for heat.

31. The method of claim 24 wherein step C includes the step of

F. partially opening some of the damper means depending upon the amount of demand for the selected mode by their respective thermostats and modulating such damper means between open and closed until the demand is satisfied;

and further comprising;

G. repeating steps B–E for the other mode when demand for the other mode has been selected in accord with step B.

32. The method of claim 24 wherein step C includes the step of

F. partially opening some of the damper means depending upon the amount of demand for the selected mode by their respective thermostats and modulating such damper means between open and closed until the demand is satisfied;

and further comprising

G. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step B in the mode setting of the monitor means.

33. The method of claim 24 wherein step C includes the step of

F. partially opening some of the damper means depending upon the amount of demand for the selected mode by their respective thermostats and modulating such damper means between open and closed until the demand is satisfied;

and further comprising

G. modulating between open and closed positions the zone dampers according to the respective control of the zome thermostats when there is no insufficient demand to require activation of the HVAC heating or cooling circuits by the zone thermostats.

34. The method of claim 24 further comprising the step of

F. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step D in the mode setting of the monitor means; and G. repeating the steps B–E for the other mode when demand for the other mode has been selected in accord with step B.

35. The method of claim 24 further comprising the step of

F. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step D in the mode setting of the monitor means; and G. modulating between open and closed positions the zone dampers according to the respective control of the zone thermostats when there is insufficient demand to require activation of the HVAC heating or cooling circuits by the zone thermostats.

36. The method of claim 24 further comprising the step of

F. repeating steps B–E for the other mode when demand for the other mode has been selected in accord with step B G. modulating between open and closed positions the zone dampers according to the respective control of the zone thermostats when there is insufficient demand to require activation of the HVAC heating or cooling circuits by the zone thermostats.

37. The method of claim 24 wherein step C includes the step of

F. partially opening some of the damper means depending upon the amount of demand for the selected mode by their respective thermostats and modulating such damper means between open and closed until the demand is satisfied;

further comprising

G. comparing such demand from step B prior to selecting the mode with the selectable mode setting of a monitor means controlling all of the zone thermostats and the HVAC unit and for either heat or cooling, and if the demands for heating and cooling are equal, the monitor means will activate the HVAC unit step D in the mode setting of the monitor means; and H. repeating steps B–E for the other mode when demand for the other mode has been selected in accord with step B.

38. The method of claim 24 wherein step C includes the step of

F. partially opening some of the damper means depending upon the amount of demand for the selected mode by their respective thermostats and modulating such damper means between open and closed until the demand is satisfied;

further comprising

G. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step D in the mode setting of the monitor means; and H. modulating between open and closed positions the zone dampers according to the respective control of the zone thermostats when there is insufficient demand to require activation of the HVAC heating or cooling circuits by the zone thermostats.

39. The method of claim 24 further comprising the step of

F. comparing such demand from step B prior to selecting the mode with the selectable mode setting of a monitor means controlling all of the zone thermostats and the HVAC unit and selected for either heat or cooling, and if the demands for heating and cooling are equal, the monitor means will activate the HVAC unit in step D in the mode setting of the monitor means;

G. repeating the steps B–E for the other mode when demand for the other mode has been selected in accord with step B; and H. modulating between open and closed positions the zone dampers according to the respective control of the zone thermostats when there is insufficient demand to require activation of the HVAC heating or cooling circuits by the zone thermostats.

40. A method for controlling a single zone HVAC unit and a single duct system including a plurality of zone ducts having a respective zone duct damper means therein regulated by zone thermostats in respective zones and the zone thermostats controlling the HVAC unit via a monitor means, comprising the steps of A. determing zone demands from a plurality of said zones by the thermostats and producing zone demand signals indicative of the demand for heating or cooling or no demand;

B. receiving zone demand signals in a monitor means;

C. comparing the number of signals demanding heating with signals demanding cooling;

D. selecting the heating or cooling mode;

E. opening said damper means of zones demanding the selected mode and closing said damper means of zones demanding the unselected mode and zones having no demand;

F. activating by said monitor means the HVAC unit in the selected mode until all zone thermostats demanding the selected mode have been satisfied; and G. deactivating the HVAC unit.

41. The method of claim 40 further comprising the step of

H. repeating steps A–G for the other mode when demand for the other mode has been determined, received, compared and selected in accord with steps A–D.

42. The method of claim 40 further comprising the step of

H. comparing such demand from step A with the selectable mode setting of a monitor means controlling all of the zone thermostats and the HVAC unit and selected for heat or cooling prior to step B, and if the demands for heating and cooling are equal, the HVAC unit will be activated in step D in the mode setting of the monitor means.

43. The method of claim 40 wherein step E includes the step of partially opening some of the other dampers depending upon the amount of demand by their respective thermostats and modulating such dampers between open and closed until the demand is satisfied.

44. The method of claim 40 further comprising the steps of

H. modulating between open and closed positions the zone dampers according to the respective control of the zone thermostats when there is insufficient demand to require activation of the HVAC heating or cooling circuits by the zone thermostats from step A.

45. The method of claim 40 wherein the respective control of the zone thermostats in step H includes the steps of:

a. determining the zone temperature, b. determining the duct temperature of the air in the supply duct, and c. comparing the zone temperature to the duct temperature and (1) when the duct temperature is warmer than the zone temperature, the thermostat operates the zone duct damper in the heating mode and substantially opens the zone duct damper upon the thermostat sending a zone demand for heat when the zone temperature is a predetermined amount below set point and substantially closes the zone duct damper upon the thermostat sensing no zone demand or a zone demand for cooling, and (2) when the duct temperature is cooler than the zone temperature, the thermostat operates the zone duct damper in the cooling mode and substantially opens the zone duct damper upon the thermostat sensing a zone demand for cooling when the zone temperature is a predetermined amount above set point and substantially closes the zone duct damper upon the thermostat sensing no zone demand or zone demand for heat.

* * * * *